US010745840B2

(12) United States Patent
Schmitz

(10) Patent No.: US 10,745,840 B2
(45) Date of Patent: Aug. 18, 2020

(54) DEVICE FOR THE TREATMENT OF STRAND-SHAPED TEXTILES

(71) Applicant: FONG'S EUROPE GMBH, Schwäbisch Hall (DE)

(72) Inventor: Johannes Schmitz, Coesfeld (DE)

(73) Assignee: FONG'S EUROPE GMBH, Schwäbisch Hall (DE)

( * ) Notice: Subject to any disclaimer, the term of this patent is extended or adjusted under 35 U.S.C. 154(b) by 104 days.

(21) Appl. No.: 15/755,940

(22) PCT Filed: Aug. 11, 2016

(86) PCT No.: PCT/EP2016/069134
§ 371 (c)(1),
(2) Date: Feb. 27, 2018

(87) PCT Pub. No.: WO2017/036758
PCT Pub. Date: Mar. 9, 2017

(65) Prior Publication Data

US 2018/0334768 A1 Nov. 22, 2018

(30) Foreign Application Priority Data

Aug. 28, 2015 (DE) ..... 10 2015 114 311

(51) Int. Cl.
*D06B 3/28* (2006.01)
*D06B 23/14* (2006.01)
(Continued)

(52) U.S. Cl.
CPC ..... *D06B 3/28* (2013.01); *D06B 3/24* (2013.01); *D06B 23/14* (2013.01); *B65H 20/14* (2013.01); *D06B 2700/36* (2013.01)

(58) Field of Classification Search
CPC . D06B 3/24; D06B 3/28; D06B 23/14; D06B 20/14; D06B 2700/10; B65H 20/14
See application file for complete search history.

(56) References Cited

U.S. PATENT DOCUMENTS 3,924,424 A * 12/1975 Watanabe ..... D06B 3/28 68/177
4,019,351 A * 4/1977 Mizutani ..... D06B 3/28 68/177
(Continued)

FOREIGN PATENT DOCUMENTS

AT 315796 B 6/1974
CN 2381653 Y 6/2000
(Continued)

OTHER PUBLICATIONS

Machine translation of CN 1284582 A to Deng. (Year: 2001).*
(Continued)

*Primary Examiner* — Joseph L. Perrin
(74) *Attorney, Agent, or Firm* — Holtz, Holtz & Volek PC

(57) ABSTRACT

A device for the treatment of strand-shaped textiles includes a treatment container, a transport nozzle array, and a transport path by way of which a material strand can be moved through the transport nozzle array in a transport direction. The transport nozzle array includes a transport nozzle with nozzle inlet and outlet orifices for the material strand, between which are delimited at least two nozzle gaps for a transport medium. At least one of the nozzle gaps is adjustable regarding its gap width. At least one nozzle gap can convey the material strand in the transport direction, and at least one nozzle gap can convey the material strand in a direction counter to the transport direction. The device also includes a control unit that selectively drives the material strand in the transport direction or in the direction counter to the transport direction by appropriate actuation of the nozzle gaps.

11 Claims, 10 Drawing Sheets

Figure 1:
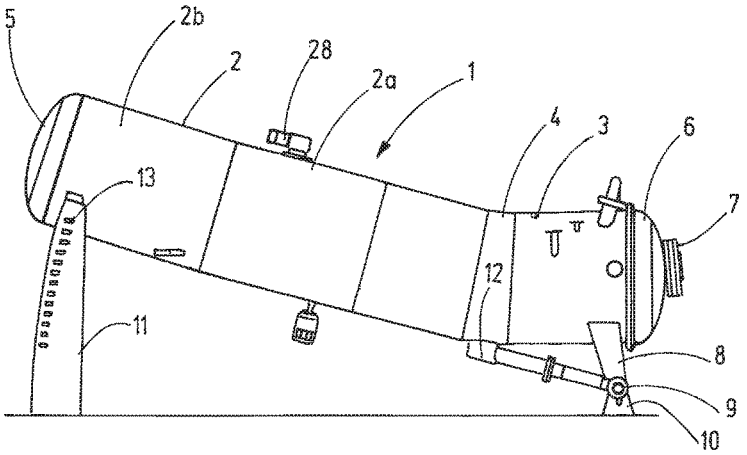

(51) Int. Cl.
*D06B 3/24* (2006.01)
*B65H 20/14* (2006.01)

(56) References Cited

U.S. PATENT DOCUMENTS

| | | | | | |
|---|---|---|---|---|---|
| 4,570,464 | A * | 2/1986 | Thompson | D06B 3/28 | 68/178 |
| 4,977,761 | A * | 12/1990 | Hacker | D06B 3/28 | 68/177 |
| 5,014,525 | A * | 5/1991 | Bene | D06B 3/28 | 15/306.1 |
| 5,235,828 | A * | 8/1993 | Aurich | D06B 3/206 | 226/158 |
| 5,395,029 | A * | 3/1995 | Kurie | F26B 13/104 | 226/7 |
| 5,520,027 | A * | 5/1996 | McCartney | D06B 3/28 | 68/13 R |
| 5,746,072 | A * | 5/1998 | Bohnke | D06B 3/28 | 68/178 |
| 5,845,355 | A | 12/1998 | Strahm | | |
| 5,850,651 | A * | 12/1998 | Ishimaru | D06B 3/28 | 8/152 |
| 7,454,931 | B2 | 11/2008 | Cordes | | |
| 8,746,018 | B2 | 6/2014 | Christ | | |
| 2005/0066694 | A1* | 3/2005 | Marcora | D06B 3/28 | 68/12.14 |
| 2006/0253999 | A1* | 11/2006 | Christ | D06B 3/28 | 8/151 |
| 2007/0137562 | A1* | 6/2007 | Cordes | D06B 3/28 | 118/325 |
| 2007/0266741 | A1* | 11/2007 | Ciabattini | D06B 3/28 | 68/5 D |
| 2007/0283725 | A1* | 12/2007 | Cordes | D06B 3/28 | 68/5 C |
| 2008/0263782 | A1* | 10/2008 | Christ | D06B 3/28 | 8/149.1 |
| 2010/0175200 | A1* | 7/2010 | Christ | D06B 3/28 | 8/152 |
| 2016/0244901 | A1 | 8/2016 | Schmitz | | |
| 2017/0067196 | A1* | 3/2017 | Biancalani | D06B 3/28 | |
| 2018/0044833 | A1* | 2/2018 | Biancalani | D06B 3/28 | |

FOREIGN PATENT DOCUMENTS

| | | | |
|---|---|---|---|
| CN | 2403798 | Y | 11/2000 |
| CN | 1284582 | A | 2/2001 |
| CN | 1616737 | A | 5/2005 |
| DE | 1941468 | A1 | 2/1970 |
| DE | 102007036408 | B3 | 12/2008 |
| DE | 102013110492 | B4 | 6/2015 |
| EP | 0806512 | A1 | 11/1997 |
| EP | 1526204 | A2 | 4/2005 |
| EP | 1985738 | A1 | 10/2008 |
| GB | 1278283 | A | 6/1972 |
| GB | 1326990 | A | 8/1973 |
| GB | 1362415 | A | 8/1974 |
| GB | 1389198 | A | 4/1975 |
| GB | 1396364 | A | 6/1975 |
| JP | H09143863 | A | 6/1997 |

OTHER PUBLICATIONS

International Search Report (ISR) dated Nov. 16, 2016 issued in International Application No. PCT/EP2016/069134.

Written Opinion dated Nov. 16, 2016 issued in International Application No. PCT/EP2016/069134.

Brazilian Office Action dated Jan. 6, 2020 (and partial English translation thereof) issued in Brazilian Application No. 112018003661-7.

Japanese Office Action dated Jan. 21, 2020 (and English translation thereof) issued in Japanese Application No. 2018-529720.

German Office Action dated Jan. 22, 2020 (and English translation thereof) issued in German Application No. 102016113627.

Chinese Office Action dated Jan. 9, 2020 (and English translation thereof) issued in Chinese Application No. 201680063263.4.

* cited by examiner

DEVICE FOR THE TREATMENT OF STRAND-SHAPED TEXTILES

The invention relates to a device for the treatment of strand-shaped textiles in the form of a rotating material strand that is set into rotation at least during part of its treatment.

Such a device, as has been described, for example, in publication DE 10 2013 110 492 B4, comprises a closable treatment container and a transport nozzle array that can be loaded with a transport medium flow. Downstream of said transport nozzle array, there is a transport path on which the material strand can be moved through the transport nozzle array in a transport direction. The transport nozzle array comprises a transport nozzle with a nozzle inlet orifice and a nozzle outlet orifice for the material strand that passes through, between which orifices a nozzle gap is delimited for the transport medium. This nozzle gap can be adjusted, i.e., its nozzle width is adjustable.

In another device of this type that, in principle, has a similar design (publication DE 10 2007 036 408 B3), a transport nozzle is provided that has two nozzle gaps arranged in sequence in transport direction, this being of advantage in the treatment of certain textiles, in particular because the gap width of the nozzle gaps is adjustable.

During the operation of such devices, for example in dyeing plants using a material transport in strand form, unfavorable adjustments of the operating conditions can cause stoppages of the material strands, e.g., due to the formation of knots or loops in the material strand, or due to the simultaneous drawing-in of two or more material strand loops.

In many cases a manual intervention is required in order to restart the material transport. If the disruption of the material strand movement occurs at high temperatures—above a temperature at which, for safety reasons, the treatment container configured as a pressurized container must be locked—it is necessary to interrupt the treatment process and to lower the temperature in order to then eliminate the material movement disruption at lower temperatures that are suitable for manual intervention. Depending on the progress of the treatment process, the desired treatment effect can no longer be achieved under certain circumstances.

In practice, dyeing plants using a material transport in strand form have been known. In these, this problem has been eliminated or minimized in that an additional, second, nozzle is provided through which the material strand is moving, said nozzle being configured in such a manner that, in switched on state, said nozzles exert a transport effect counter the normal transport direction. During the normal movement of the material strand, this additional nozzle is without effect. In the event of the occurrence of a malfunction of the movement of the material strand, a transport medium is applied to said additional transport nozzle if the transport nozzle is switched off, so that the material strand is conveyed counter the normal transport direction. However, this solution is cost-intensive due to the use of two independent autonomous nozzles, apart from the increased space requirement in the treatment container. Furthermore, the nozzles are to be provided with a design-specified nozzle gap so that, in order to change the nozzle characteristics as are required in the treatment of various material qualities, the nozzles need to be exchanged, which involves considerable time and cost.

The material strand treated in such devices using a rotating material strand is continuous. Prior to treatment, a corresponding length of the material strand is placed in the treatment container, in which case the ends of said strand are sewn together before the treatment is begun. Upon completion, the material strand has to be severed again at the seam so that the strand may be removed from the treatment container via the opened loading opening. For the location of the seam that is required in doing so, a magnet is inserted, as a rule, in the seam region in the material strand. At the end of the treatment process the transport of the material strand is ended and the seam located. When the magnet placed in the seam region reaches a sensor, the material drive is switched off. Due to the high speed of the rotating material strand, the detected seam with the magnet is continued to be transported until the drive system comes to a stop. Consequently, it is necessary to manually pull back the material strand by the length of the material strand that has been transported too far, and to manually locate the magnet and thus the seam. It is only then that the seam is accessible to the user and the device may be opened for the unloading step. This operation requires relatively much time and is thus cost-intensive. In this case, it would be desirable to be able to automatically move back the material strand at low speed counter the transport direction, so that the seam and the magnet become directly accessible to the user reaching in through the loading opening of the treatment container.

As already mentioned, it is desirable for a group of textile materials to use one transport nozzle array with at least two nozzle gaps that are arranged in sequence in transport direction. As a rule, the gap widths of these nozzles are relatively small, so that a relatively low volume flow of the transport medium in conjunction with a high nozzle pressure is used. In order to operate a treatment device of the type having such a nozzle with several gaps as is concerned here, a mechanical nozzle change is frequently required. The refitting results in additional personnel costs as well as in plant down-times and reduces the productivity of the plant. Therefore, there exists a need for avoiding this additional effort and the costs for the additional nozzles.

Therefore, it is the object of the invention to provide a device of the aforementioned type for the treatment of strand-shaped textiles in the form of a rotating material strand, in which case the previously mentioned needs have been remedied and which is distinguished by a transport nozzle array that can appropriately act on the material strand that passes through, without greater additional expense or space requirement.

In order to achieve this object, the device according to the invention comprises the features of claim 1.

The new device for the treatment of strand-shaped textiles in the form of a rotating material strand displaying the aforementioned features is characterized in that the transport nozzle array comprises a transport nozzle with a nozzle inlet orifice and a nozzle outlet orifice for the material strand that passes through, between which are delimited at least two nozzle gaps for the transport medium. The gap width of at least one of the nozzle gaps is adjustable. Furthermore, at least one nozzle gap of the nozzle gaps for conveying the passing material strand in transport direction and at least one nozzle gap for conveying the material strand in a direction counter the transport direction are provided. To accomplish this, control means are provided in order to selectively drive the passing material strand via an appropriate activation of the nozzle gaps in the transport direction or in the direction counter said transport direction.

In an advantageous embodiment the transport nozzle has three nozzle gaps—one of which being disposed for conveying the passing material strand counter the transport direction—which effectively are configured so as to be adjustable regarding their gap width independently of each other. At least one of the nozzle gaps may be continuously adjustable, but embodiments in which this adjustment is incrementally performed on one or more nozzle gaps are also conceivable.

The new device allows the passing material strand to be driven forward and in reverse at different intensities, for example, using at least two narrow gaps and, alternatively, one large gap in "forward direction" and using one or more gaps in "reverse direction", wherein, naturally, due to the closure of the nozzle gaps acting counter the intended conveying direction, it is avoided that the nozzle gaps act against each other. The control of the nozzle gaps can be automated at minimal cost, in which case the nozzle gaps and the mechanisms of the control means coupled therewith can be cost-effectively accommodated in a common nozzle housing that, furthermore, is distinguished by minimal space requirements in the treatment container.

In an advantageous embodiment, the device comprises a nozzle housing with the nozzle inlet and the nozzle outlet, in which housing the at least one nozzle element delimiting one of the nozzle gaps is adjustably arranged, said nozzle element being activatable by the control means. It is expedient for this nozzle element to be configured in the form of a closed frame or ring so that an annular gap is attained for the material strand that passes through.

As has already been mentioned hereinabove, the seams of each rotating material strand are opened and the material is moved out of the treatment container at the end of each treatment process. Usually, in practical applications, one to six material strands are treated at the same time—depending on equipment size. At the end of the treatment process the seams of the one to six material strands are located successively with the aid of sewn-in magnets. In treatment plants, for example dyeing plants using two to six material strands, the driving or transport medium flow of each transport nozzle can be stopped by respectively dedicated shutoff valves. When a seam is located via its magnets, the driving flow of the respective transport nozzle is stopped by its associate valve and the transport reel is switched off. The material strand is decelerated and comes to a stop after approximately 3 meters to 15 meters, depending on the respective material rotating speed. By actuating the "reverse" transport direction, the otherwise necessary manual pulling back of the potentially hot material strand can be performed automatically, thus clearly reducing the manual effort of unloading. In another advantageous embodiment, the transport nozzle can, at the same time, take over the function of the shutoff valve. To do so, the nozzle gaps for conveying the passing material strand in transport direction and in the direction counter the transport direction are configured so that they can be closed and controlled by control means in the sense of a combined closure of the nozzle gaps. The design of the material strand transport system can thus be clearly be embodied in a more cost-favorable manner.

The form of the nozzle inlet and the nozzle outlet, as well as the configuration of the nozzle elements, are not subject to constraints. This form may be selected to be circular, oval, rectangular, square or polygonal, depending on the respective requirements, to mention only a few examples.

Advantageous developments and embodiments of the new device are the subject matter of dependent claims.

Figure 2:
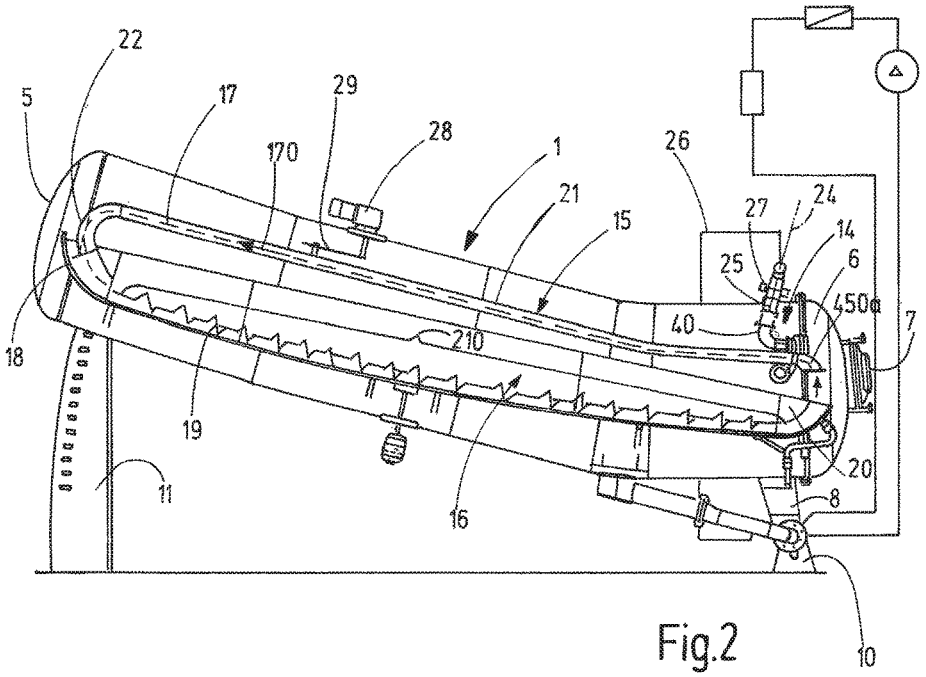
Figure 3:
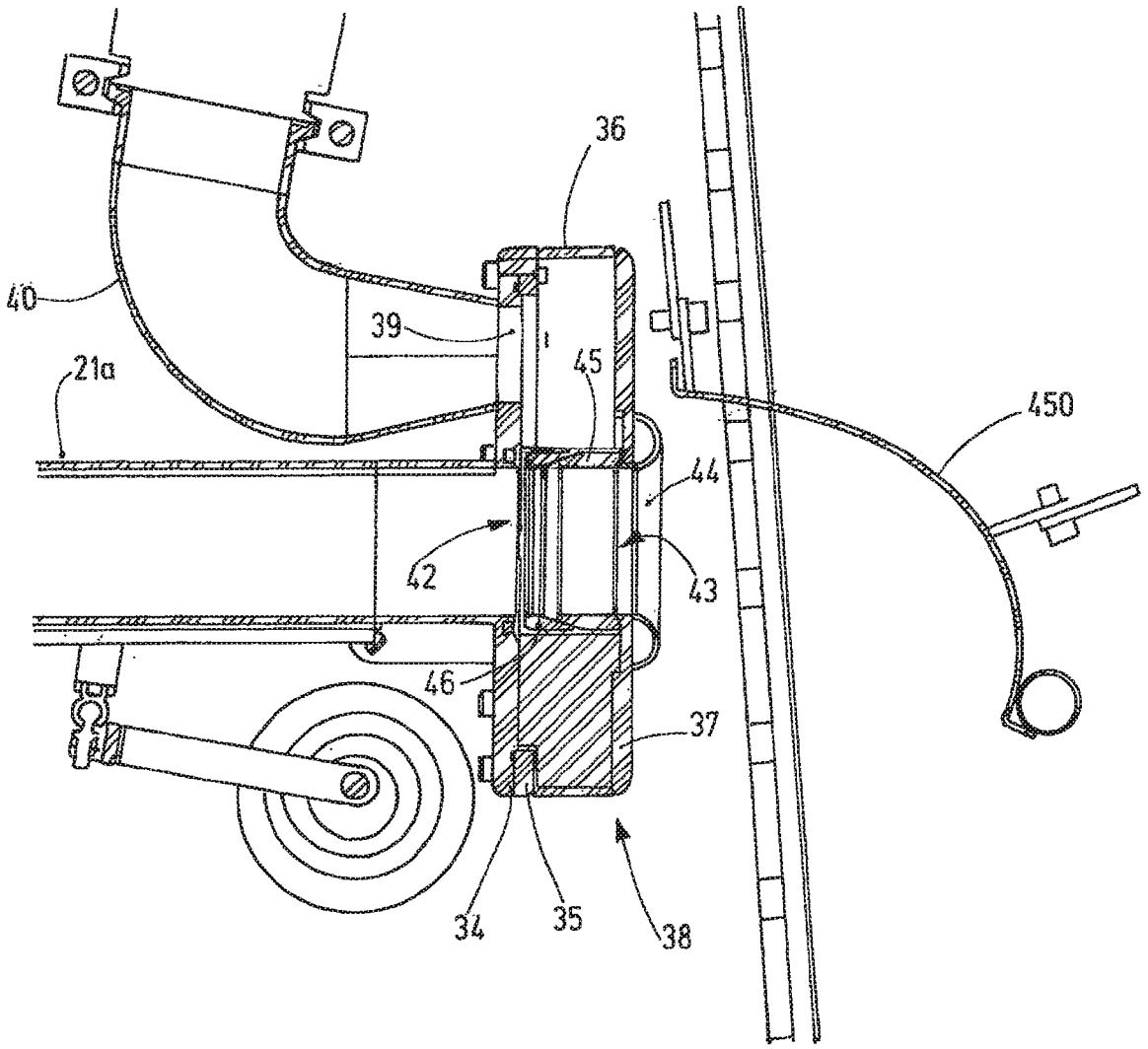
Figure 4:
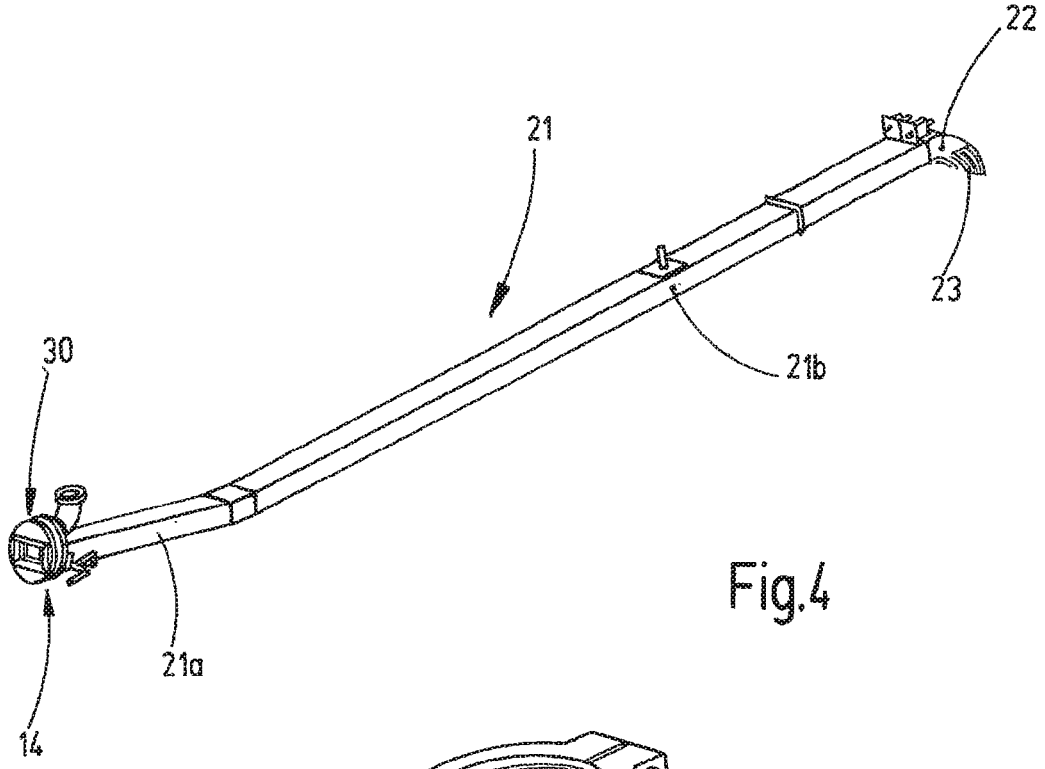
Figure 5:
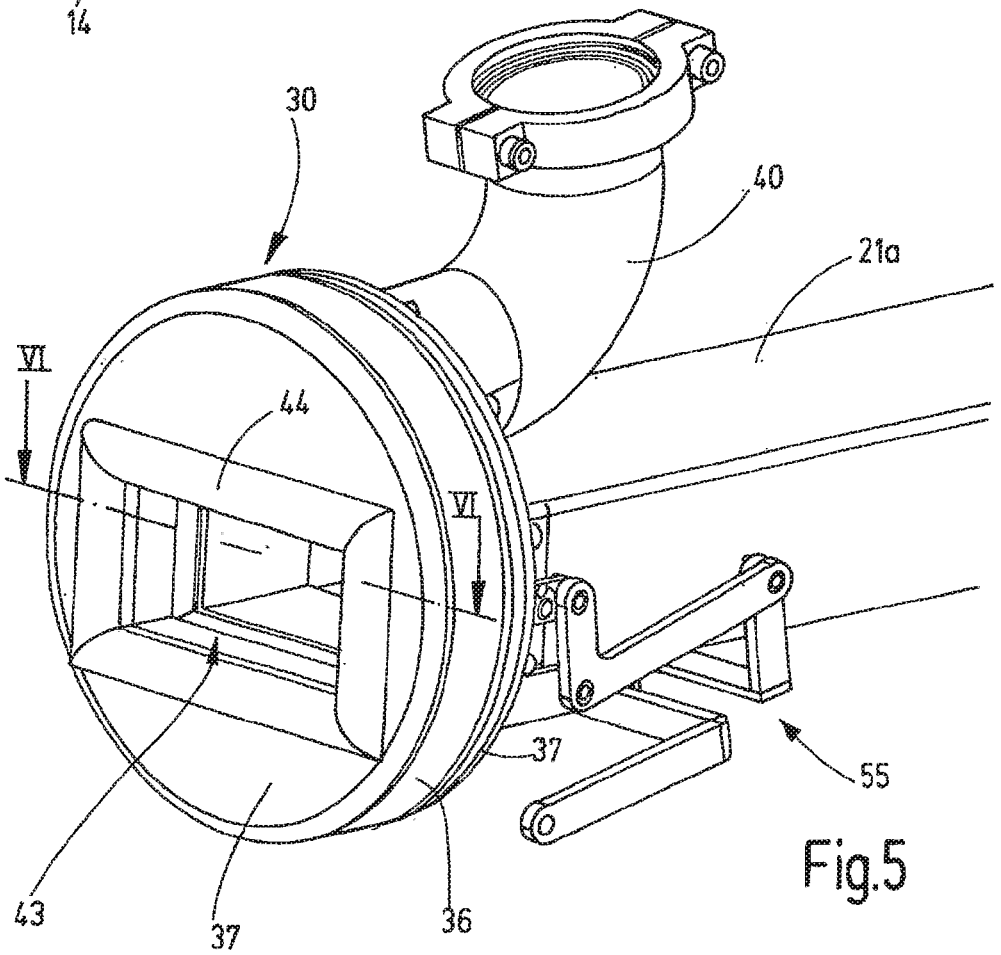
Figure 6:
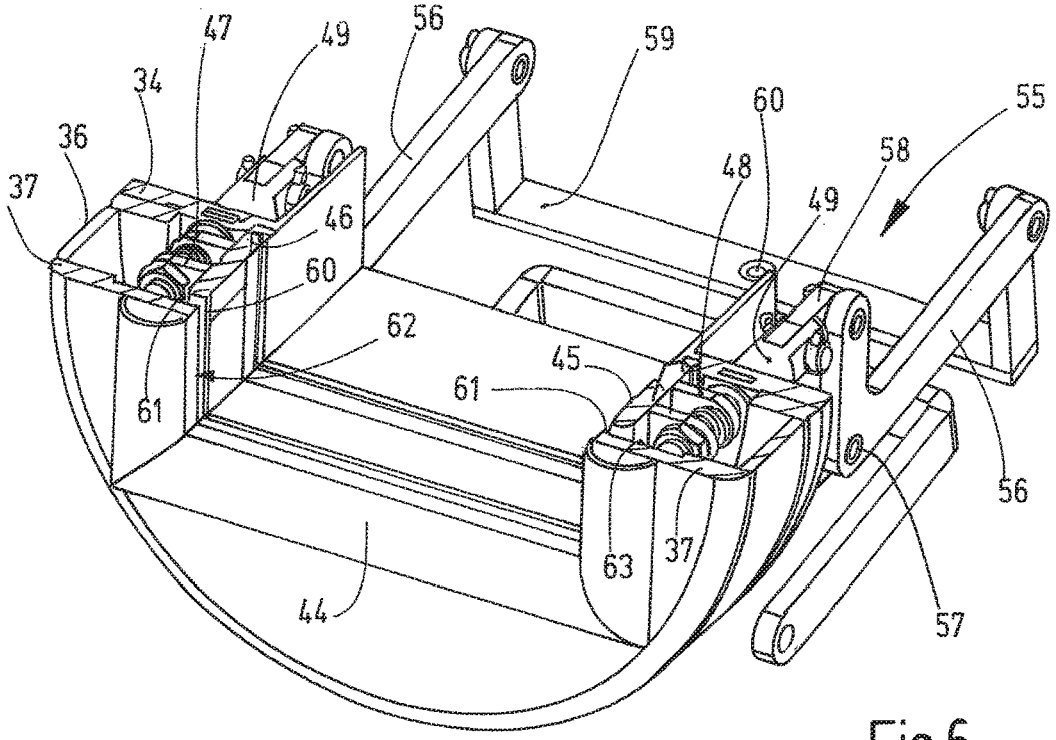
Figure 7:
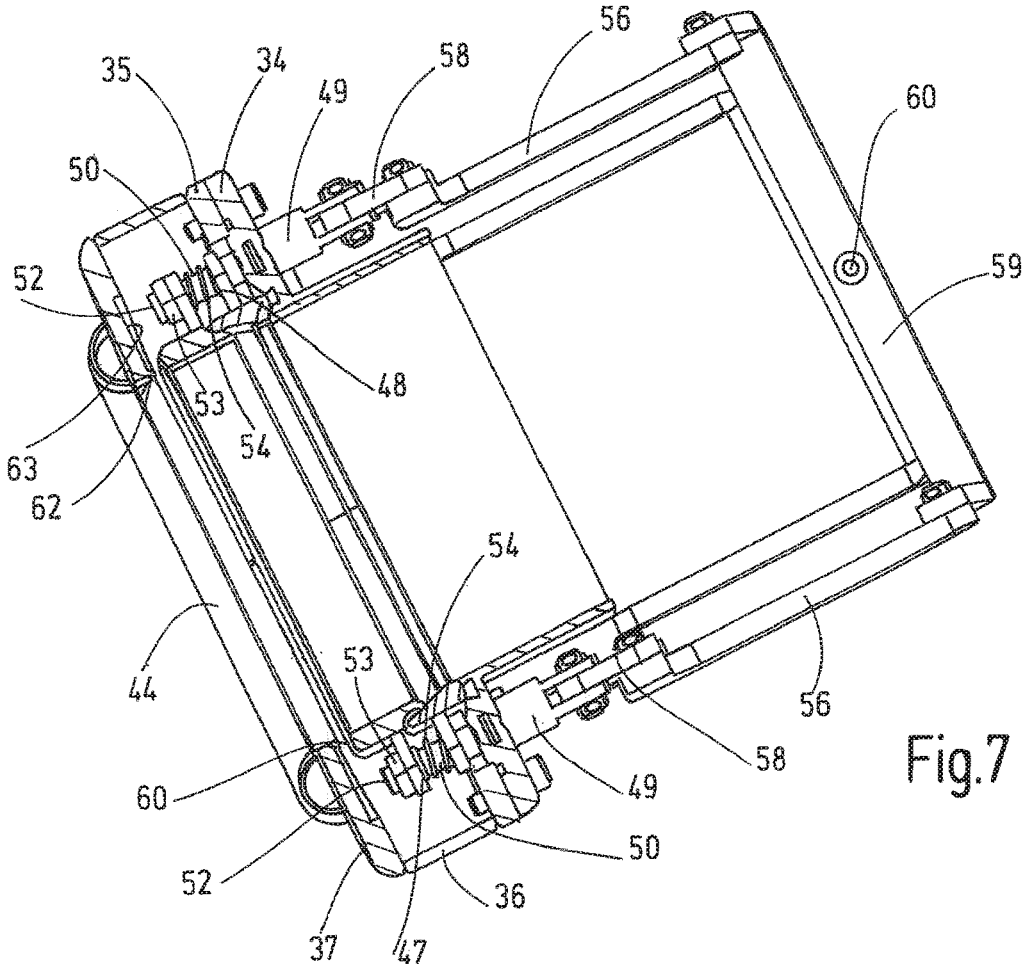
Figure 8:
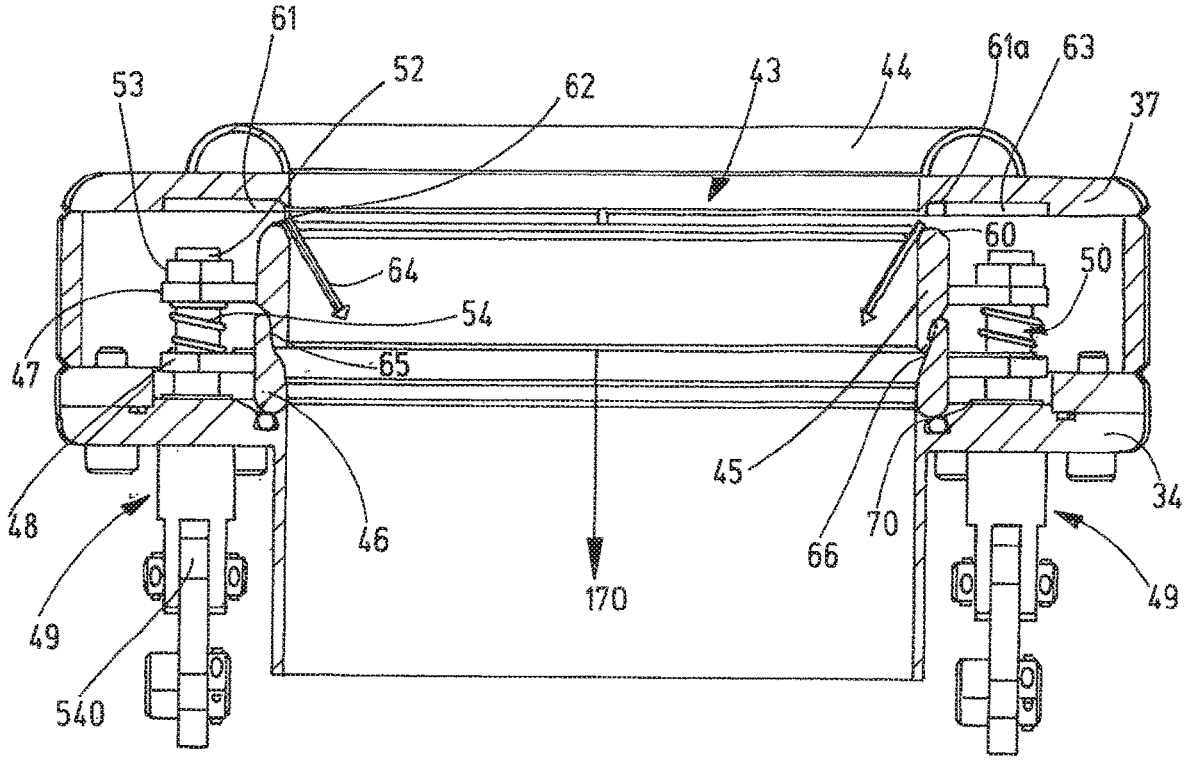
Figure 12:
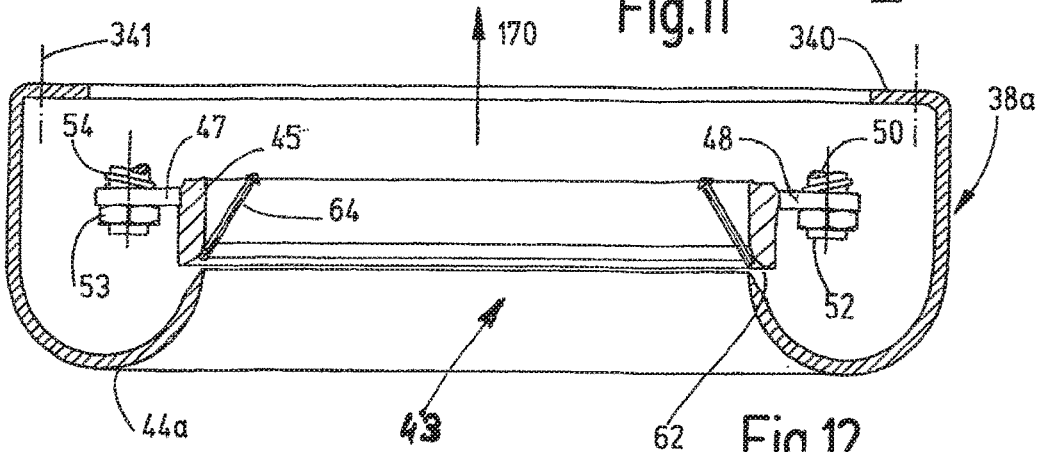
Figure 13:
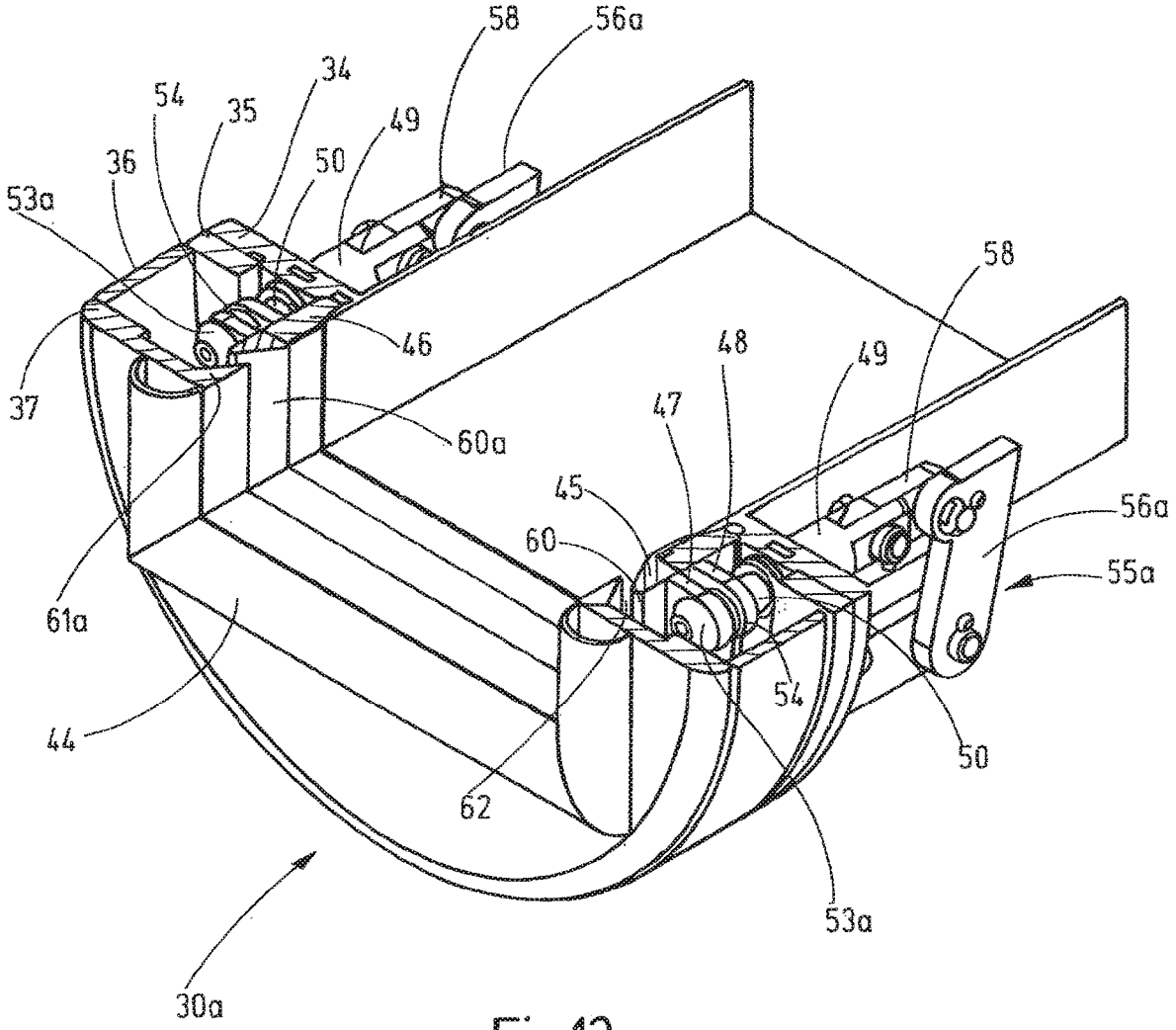
Figure 14:
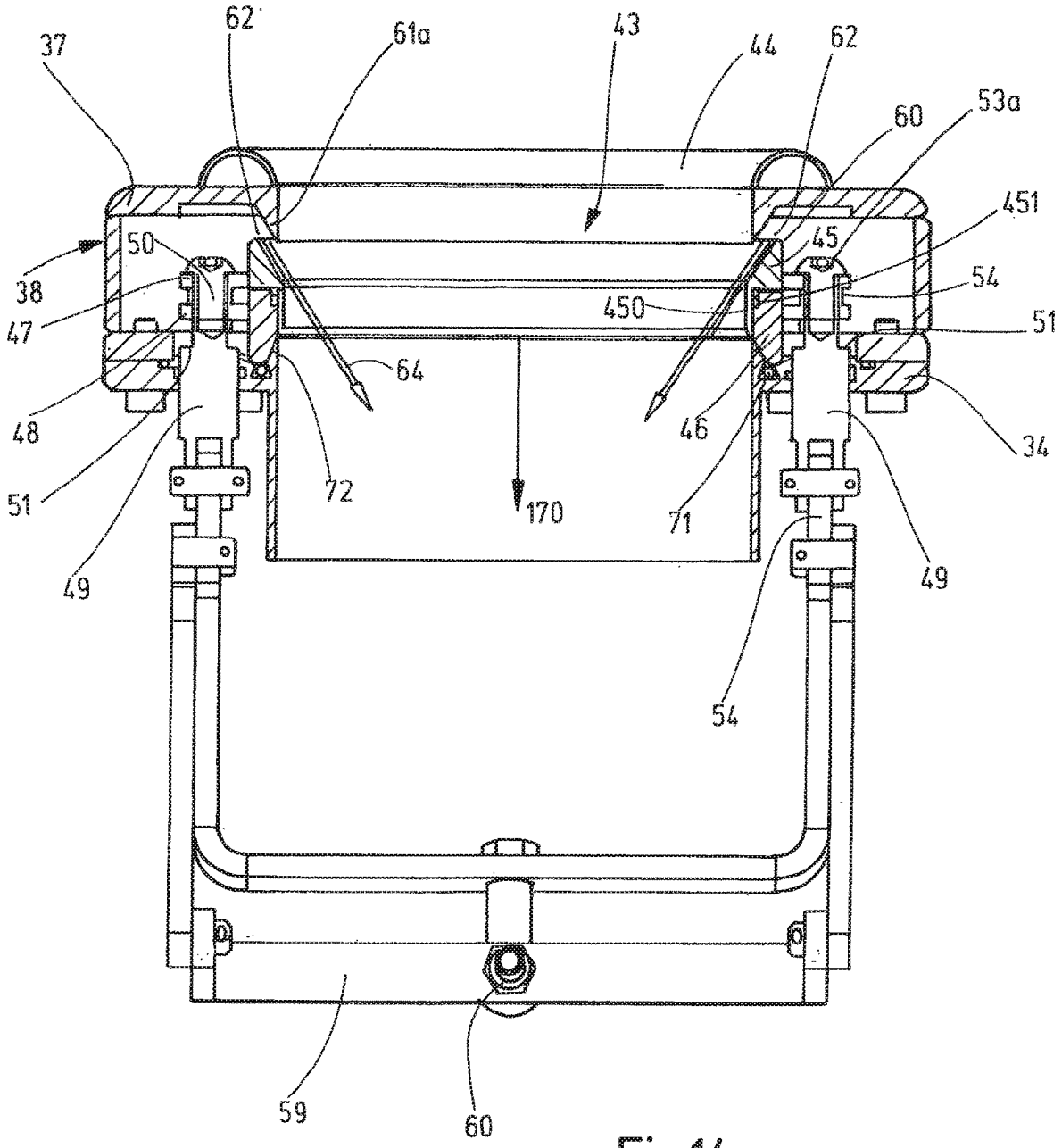
Figure 15:
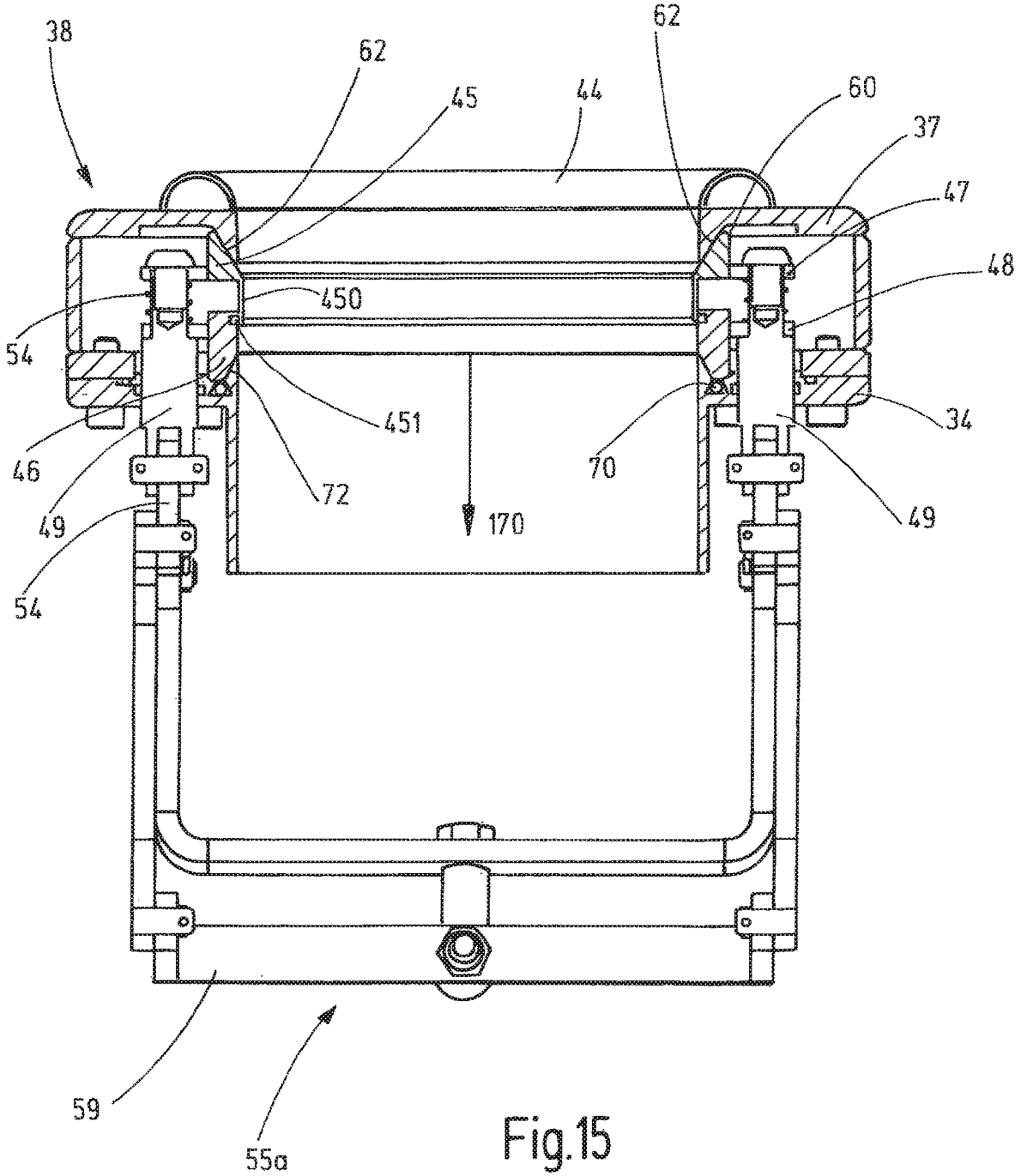
Figure 16:
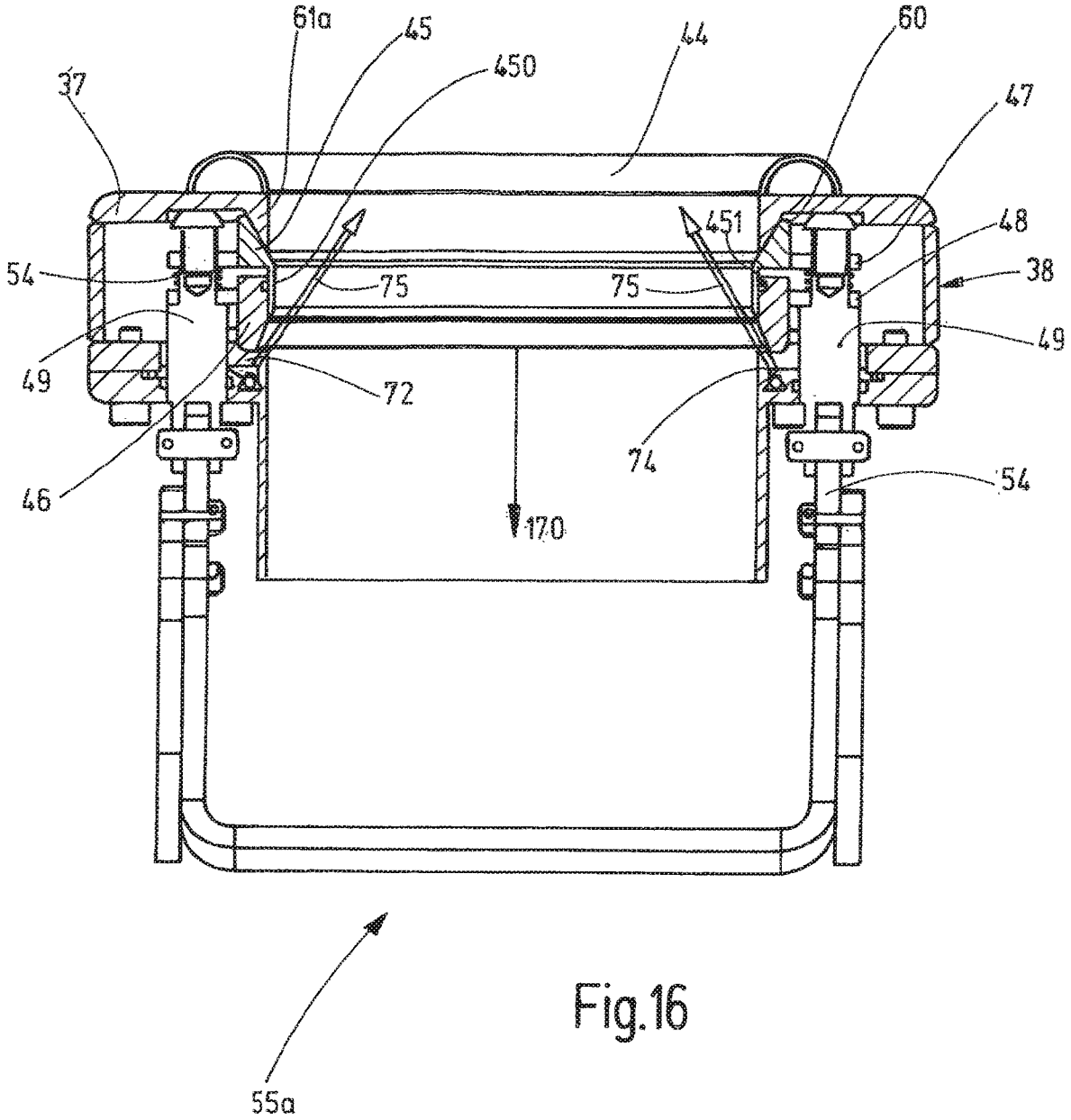

The drawings show an exemplary embodiment of the subject matter of the invention. They show in FIG. 1 a schematic representation, in side view with pivoted-up treatment container, of a device according to the invention in the form of a so-called long storage machine;

FIG. 2 a side view of the long storage machine as in Figure one, in longitudinal section;

FIG. 3 a schematic side view of the transport nozzle array of the long storage machine as in FIG. 2, in axial section;

FIG. 4 a perspective side view, and using a different scale, of a transport path of the long storage machine as in FIG. 1;

FIG. 5 a perspective side view, and using a different scale, of the transport nozzle array as in FIG. 3;

FIG. 6 a perspective representation, along section line VI-VI of FIG. 5, of the transport nozzle array as in FIG. 5;

FIG. 7 a corresponding representation, and in another perspective view, of the transport nozzle array as in FIG. 6;

FIGS. 8-11 a plan view of the transport nozzle array as in FIGS. 6, 7 in a sectional view corresponding to FIG. 6 and illustrating various selectively adjustable settings of the nozzle elements;

FIG. 12 a corresponding sectional view and a detail of a deep-drawn housing part of the transport nozzle of the transport nozzle array as in FIG. 8, in a corresponding sectional view and in detail;

FIG. 13 the transport nozzle array of the long storage machine as in FIG. 3, in a modified embodiment and in a representation similar to that of FIG. 6; and FIGS. 14 to 16 a plan view of the transport nozzle array as in FIG. 12, in a representation according to FIGS. 8-11, illustrating various selectively adjustable positions of the nozzle elements.

The inventive long storage machine illustrated in FIGS. 1, 2 as the exemplary embodiment is disposed for the treatment of strand-shaped textiles in the form of a continuous material strand that is rotated at least during part of the treatment.

The machine comprises an elongated, essentially tubular, treatment container 1 that consists of a longer cylindrical tube section 2 and a shorter likewise cylindrical tube section 3 having the same diameter, whereby these are connected to each other via a wedge-shaped coupling tube piece 4 and are closed on the end sides with the bases of torispherical heads or ellipsoidal heads 5, 6, for example. The detachably mounted torispherical head 6 is provided with a loading door 7 leading into the interior of the container. Together, the axes of the two tube sections 2, 3 subtend an oblique angle of 165°. On its front end, the treatment container 1 is supported by two support feet 8 mounted to opposite sides on the tube section 3, said support feet being supported so as to be pivotable about a horizontal axis of rotation 9 on stationary bearing blocks 10.

On the rear end of the treatment container 1, there is provided a lifting device contacting the outside of the longer tube section 2, said lifting device being schematically illustrated at 11 and operating with a not specifically illustrated lifting spindle or, likewise not illustrated, lifting cylinders and forming adjustment means for the treatment container 1. When the treatment container is in a (not illustrated) lowered position, the fluid contained therein is able to flow toward and gather on the container bottom at a lowest point 12 in the region of the coupling tube part 4 and can be extracted from this lowest point. In its respectively adjusted inclined position, the treatment container 1 can be locked by the adjustment means of the lifting device 11, this being indicated by catches 13.

Arranged in the treatment container 1, as is particularly obvious from FIG. 2, there are a transport nozzle array 14, an adjoining transport path 15 and a trough-shaped or tub-shaped elongated sliding bottom 16 that make it possible to put a continuous material strand indicated schematically at 17 into rotation. The material strand sucked up by the transport nozzle array 14 moves on the transport path 15 to the material strand inlet side 18 of a storage section 210 of the treatment container 1, said storage section receiving a plaited material strand package as indicated at 19, in which said treatment container 1 extends the sliding bottom 16 carrying the plaited material strand package 19 from the material strand inlet side 18 to a material outlet side 20.

The transport path 15 arranged in the treatment container 1 above the sliding bottom 16 comprises a transport tube 21 whose basic design can be inferred from FIG. 4, in particular. Starting at a short straight tube section 21*a* having a constant square or rectangular cross-section that is connected to the transport nozzle array 14, the transport tube 21 has, in a long section 21*b*, a conical expansion of the flow channel formed by the transport tube, said channel's cross-sectional form thus becoming increasingly more rectangular. Adjoining the end of the transport tube section 21*b* facing away from the transport nozzle array 14, there is a material strand outlet bend 22 having a rectangular cross-section and extending over approximately 90° and having a perforation 23 in the region of its lateral walls and at least its radial outside wall. It terminates in a manner obvious from FIG. 2 in the sliding bottom 16 of its material strand inlet side 18.

The material strand 17 is plaited on the material strand inlet side across the width of the tub-shaped sliding bottom 16 in that the material strand outlet bend 22 is imparted with a back and forth uniform motion via the transport tube 21. For this purpose, the transport tube, together with the transport nozzle array 14, is supported so as to be pivotable about an axis of rotation 24 (FIG. 2) that extends, through a straight tube connecting piece 25 of a not specifically identified pump, a heat exchanger and a transport medium supply line 26 containing a fluff filter, to the transport nozzle array 14. At 27, the tube connecting piece 25 can be rotated in a sealed manner in a pivot bearing mounted to the treatment container 1.

The transport tube 21 is imparted with the back and forth pivoting motion by a drive motor 28 (FIG. 2) attached to the treatment container 1, said motor being connected via a lever mechanism 29 in such a manner that the transport tube 21 is moved back and forth at uniform speed over its pivot range.

The long storage machine so far described as the example of a device according to the invention is described in detail in publication DE 10 2013 110 492 B4.

At this point is should be mentioned that the device according to the invention is by no means restricted to the embodiment in the form of a long storage machine. It can be used in the same way in machines of different designs, for example so-called short storage machines; regarding this, reference is being made to publication EP 1 722 023 A2, for example. Likewise, devices using a pressureless treatment container that may optionally be polygonal are within the scope of the invention.

The tube section 21*a* having a constant cross-section along its length connects the transport path 15 to a transport nozzle 30 of the transport nozzle array 14, whose precise design can be inferred from FIGS. 3 to 11, in particular:

Attached in a sealed manner to the tube section 21*a* there is a cylindrical housing base plate 34 that is screwed to an annular flange 35 and forms—together with the latter as well as a cylindrical lateral wall 36 and a cylindrical cover plate 37 connected to the latter—a medium-tight, drum-shaped uniform nozzle housing 38. Laterally next to the tube section 21*a* there is provided in the base plate 34 an inlet opening 39 for a transport medium—in this case treatment fluid—that may flow through a tube bend 40 of the treatment fluid supply line 26 (FIG. 2) into the nozzle housing 38.

Coaxially to the nozzle outlet orifice 42 for the passing material strand, said nozzle outlet orifice 42 being delimited by the tube section 21*a*, there is provided, in the oppositely arranged cover plate 37 of the nozzle housing 38, a material strand inlet opening 43 through which enters—during operation—the material strand 17 into the nozzle housing 38. In the illustrated exemplary embodiment the nozzle inlet orifice 43 is rectangular with approximately horizontally arranged longer sides. However, both nozzle orifices 41, 43 may have a form that is appropriate for the respective purpose of use; they may have a square, polygonal, circular, oval, etc., form. Likewise, it is not absolutely necessary that both nozzle orifices 42, 43 have the same edge configuration. In nozzle orifices having different edge configurations, an appropriate transition region is present in the nozzle housing 38.

On the outside of the cover plate 37 there is attached a rectangular frame 44 that encloses the nozzle inlet orifice 43, the frame legs of said frame—as can be inferred, in particular, from FIGS. 3, 5—having an essentially semi-cylindrical form and thus forming guide elements for an entering material strand, and being able, at the same time, to affect the flow conditions of the transport medium.

At an axial distance upstream of the nozzle inlet orifice 43 in the treatment container 1, there is arranged in transverse direction a guide baffle 450 having an approximately partially cylindrical shape. The task of the guide baffle 450 is to safely guide the material strand 17 lifted off the sliding bottom 16 on the material strand outlet side 20 into the nozzle inlet orifice 43. Basically, it is also conceivable to provide, instead of the guide baffle 450, a funnel-shaped material strand inlet bend 450*a* directly connected to the nozzle housing 38, as is indicated as an alternative at 450*a* in FIG. 2.

Arranged in the nozzle housing 38 there are two nozzle elements 45, 46 that are closed in the form of a ring and are adapted to the circumference of the nozzle inlet orifice 43 so as to be adjustable in alignment with the nozzle inlet orifice 43 and the nozzle outlet orifice 42. Each of the nozzle elements 45, 46 has, on its outside 2, diametrically opposed flanges 47 and 48, respectively, said flanges being slidably supported on a rod 49 on each side of the nozzle orifices via associate, aligned bearing holes. The two rods 49 that are oriented parallel to each other and opposite each other are passed through the base plate 34 of the nozzle housing in a sealed manner and are slidably supported on the base plate 34 relative to said base plate. Each of the rods 49 has a smaller-diameter section 50 located in the nozzle housing 38, said section being delimited, on the one side, by an annular shoulder 51 (FIG. 11) and, on the other side, by a nut 53 screwed to a corresponding threaded part 52. Spring means in the form of compression springs 54 slipped onto the section 50 are provided between the flanges 47, 48, said springs attempting to push the two flanges 47, 48 and thus the nozzle elements 45 46, away from each other in axial direction.

On their side projecting from the nozzle housing 38, the two rods 49 have slits at 54 (FIG. 8) and can be adjusted together, via a lever mechanism acting as a link mechanism 55, relative to the base plate 34 of the nozzle housing 38. The link mechanism 55 is part of control means that allow the selective individual or joint axial adjustment of the nozzle elements 45, 46, as will be described in detail hereinafter. The link mechanism 55 comprises two L-shaped actuating levers 56 that are supported by a common horizontal axis so as to be pivotable on the nozzle housing 38 and whose one leg is hinged via a link 58 to the associate rod 49, while the other leg is connected in a hinged manner to a common U-shaped actuating bracket 59. The actuating bracket 59 is connected to an actuating rod indicated at 60, said rod extending in a sealed manner out of the treatment container 1 and allowing the adjustment of the nozzle elements 45, 46 from the outside by means of a not specifically illustrated servomotor or other appropriate actuating means.

Depending on their respective position, the two nozzle elements 45, 46 delimit nozzle gaps located between them and/or the cover plate 37 or the base plate 34 of the nozzle housing 38, which said nozzle gaps can be selectively opened or closed independently of each other, or be adjusted regarding their gap width, in conjunction with which reference is made in particular to FIGS. 8 to 11:

On its side facing the nozzle inlet orifice 43, the nozzle element 45 is provided with a rounded edge 60 (FIGS. 6, 8) that interacts with an associate seat 61 provided in the cover plate 37 and being able to delimit a first nozzle gap 62 with said seat (FIG. 7, 8). The seat 61 is formed on an annular recess 63 provided in the cover plate 37, the edge of said recess being located on the inside at 61*a* and being curved in material strand transport direction indicated at 170 in such a manner that, when the gap 62 is opened, a gap flow having a strong component acting in material strand direction 170 occurs as indicated, for example, at 64 in FIG. 8.

Figure 10:
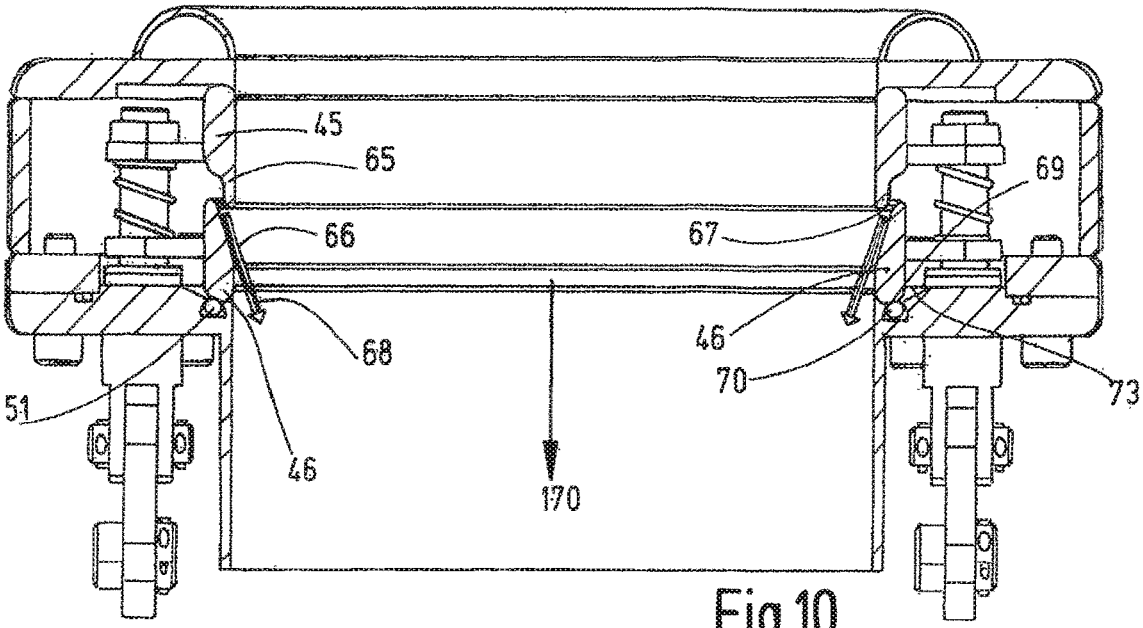

On the face located opposite the rounded edge 60, the nozzle element 45 is provided with a curved chamfer at 65, the tapering part of said chamfer pointing in the material transport direction 170. An edge part of the other nozzle element 46 provided with a corresponding chamfer 66 can interact with this chamfered part 65 while forming a second nozzle gap 67 (FIG. 10). In doing so, the arrangement is such that, with the nozzle gap 67 open, a gap flow indicated at 68 is the result, said gap flow containing a component that strongly acts in the material strand direction 170.

Figure 11:
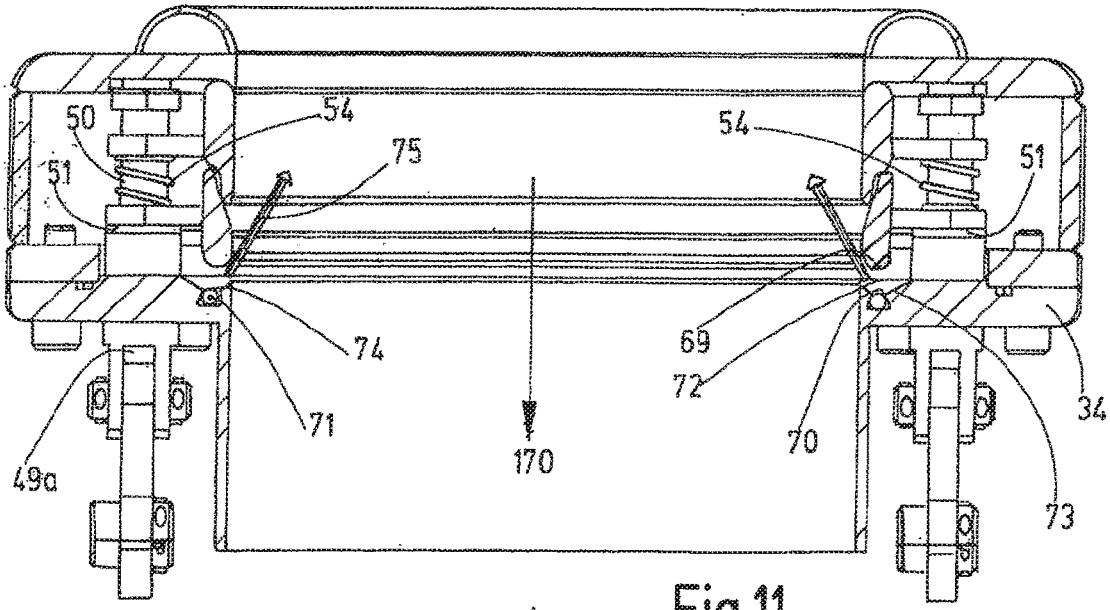

On its side opposite the face, the nozzle element 46 is rounded on its edge at 69 (FIGS. 10, 11). Said element is associated with a seat 70 provided in the base plate 34, said seat containing a seal indicated at 71. When the nozzle element 46 is lifted off the seat 70, a third nozzle gap 72 is delimited between the edge 69 of said element and the seat 70 (FIG. 11). In doing so, the seat 70 is configured in an annular recess 73 of the base plate 34 with an upward protruding lip 74 facing against the material strand transport direction (FIG. 11) in such a manner that, when the nozzle gap 72 is opened, a gap flow indicated at 75 results, said gap flow containing a component that strongly acts counter the material transport direction 170.

The function of the transport nozzle array 14 described hereinabove is illustrated by FIGS. 8 to 11:

According to FIG. 8, the two rods 49 are pulled out of the nozzle housing 38 up to the stop. In doing so, the nozzle element 45 is in a position of maximum opening of the first nozzle gap 62. The gap flow 64 is dominant in view of the characteristic of the transport nozzle. A high volume flow of the transport medium acts on the material strand. The nozzle pressure is comparatively low. The second and third nozzle gaps 67 and 72 are closed. Due to the compression springs 50, the other nozzle element 46 is pressed with great force against its seat 70.

Figure 9:
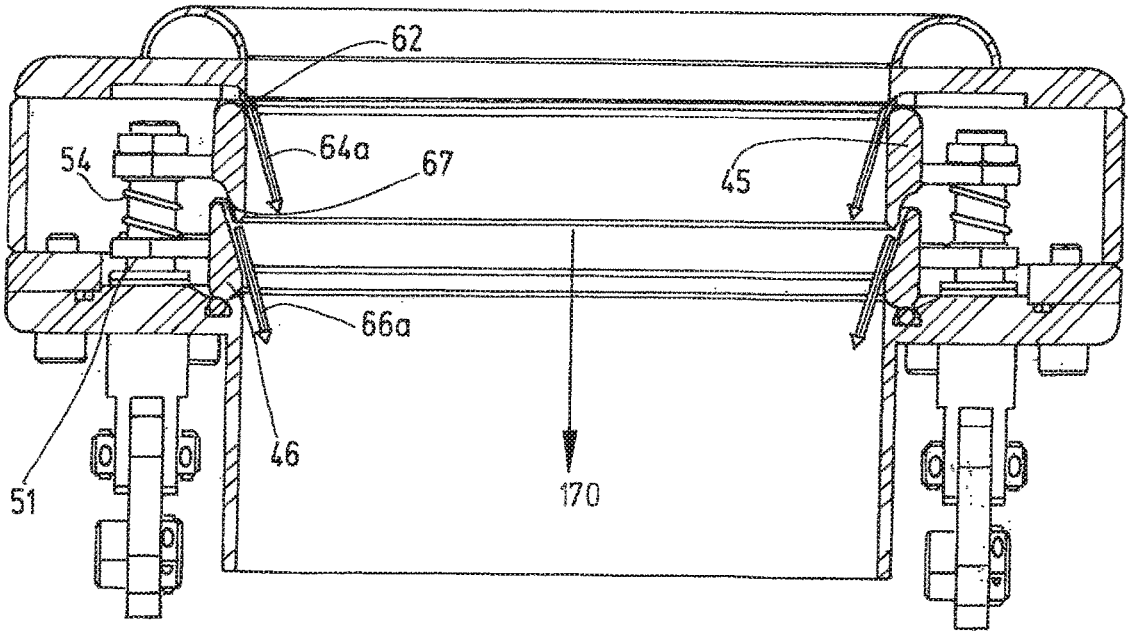

In the operating state shown in FIG. 9, the two rods 49 are inserted into the nozzle housing 38 to such an extend that the first nozzle gap 62 and the second nozzle gap 67—located between the two nozzle elements 45, 46—i.e., downstream in material strand transport direction 170 are opened. The nozzle gap width may be, for example, 2 mm in the case of both nozzle gaps 62, 67. Now the material strand is moved forward in material strand transport direction 170 by means of two forward-directed nozzle jets, as is indicated by the gap flows 64*a*, 66*a* in FIG. 9. The third nozzle gap 72 is closed.

However, the rods 49 may also be pushed into the nozzle housing 38 to such an extent that the situation depicted in FIG. 10 will result, wherein only the second nozzle gap 67 existing between the two nozzle elements 45, 46 is opened. With this setting, only a narrow nozzle gap is opened. Comparatively high material strand speeds are achieved. The first nozzle gap 62 and the third nozzle gap 72 are closed.

In the operating state shown in FIG. 11 the two rods 49 are inserted farther into the nozzle housing 38, i.e., to such an extent that the first nozzle gap 62 between the nozzle element 45 and the stationary cover plate 37 on the housing and the second nozzle gap 67 between the two nozzle elements 45, 46 are closed. The third nozzle gap 72 between the nozzle element 46 and the base plate 34 forming one part of the nozzle housing 38 is opened. With this setting of the nozzle elements 45, 46, a jet of transport medium directed in reverse as indicated by the gap flow 75 is generated. Consequently, the material strand is transported in reverse.

The transport medium used for driving the material strand may be liquid, as well as gaseous. It may also be a gas flow charge with fluid droplets.

The cross-section of the transport system of the transport nozzle array 14 and the transport path 15 may be round, as well as polygonal, or may take any other form that is practical.

The nozzle elements 45, 46, including the parts of the link mechanism 55 for initiating the adjustment and actuation forces for the nozzle elements are designed in such a manner that they can be manufactured by precision casting. As a result of this, there are additional considerable reductions of the manufacturing costs. Likewise, the base plate 34 of the nozzle housing 38 is designed in such a manner that it can also be manufactured by precision casting. This, too, results in a lowering of the costs for material and manufacture. The cover plate 37 and the adjoining lateral wall 36 of the nozzle housing 38—optionally including the guide elements 44—can be manufactured particularly advantageously as a deep-drawn sheet metal piece, likewise at lower cost for material and manufacture.

One example of this embodiment is shown in FIG. 12:

The deep-drawn housing part is shown at 38*a*. It has a flat base surface 340 which is screwed to the base plate 34 by means of screws indicated at 341. On the opposite side, the housing part 38*a* is drawn inward in a bead-like manner at 44*a*, thus delimiting the material strand inlet opening. The bead-like part 44*a* has an approximately semicircular cross-section and, with its pointed edge together with its adjacent nozzle element 45, delimits the first nozzle gap 62, as can be inferred from FIG. 12. In this case, the bead-like part 44*a* acts not only as a guide element for the material strand moving into the material strand inlet opening 43, but it—at the same time—effects a considerable improvement of the flow conditions in that it contributes to the prevention of undesirable vortices in the transport medium flow and effects essentially laminar flow conditions. In the embodiments described hereinabove, the material strand inlet opening 43 may have a rectangular, square and/or otherwise appropriate form. For reasons of simplicity, FIG. 12 shows only the nozzle element 45.

Considering another modified embodiment shown in FIGS. 13 to 16—similar to FIGS. 6 and 10 to 12—components that are the same as in the previously mentioned Figures are identified with the same reference signs and are not explained again.

In this embodiment, the smaller-diameter section 50 of the rods 49 is provided on a bolt 53*a* that is screwed into the respective rod 49. Furthermore, the link mechanism 55*a* that is part of control means and has actuating levers 56*a* is configured slightly differently, wherein, however, the common U-shaped actuating bracket 59 (FIG. 14) having the actuating rod indicated at 60 allows also in this case the adjustment from the outside of the nozzle elements 45, 46 by a not specifically shown servomotor or other appropriate adjustment means.

Apart from these rather minimal engineering changes compared to the exemplary embodiment of the transport nozzle depicted in FIGS. 6 to 11, the two nozzle elements 45, 46 closed in the form of a ring enclosing the not specifically illustrated material strand are configured in such a manner that the nozzle gap 67 that can be selectively adjusted between the two nozzle elements 45, 46 in the embodiment according to FIGS. 6 to 11 is omitted. Rather, on the one nozzle element 45, on its side facing the other nozzle element 46, there is formed an all around extending smooth-walled delimiting apron 450 that extends axially projecting over the other nozzle element 46, as can be seen in FIG. 16, for example. On the other nozzle element 46 there is provided, in a corresponding peripheral groove, all around a continuous sealing ring 451 that is in contact under tension with the apron 450. Consequently, an axially movable sealing location is provided between the two sealing elements 45, 46, said sealing location preventing the penetration of transport medium and, at the same time, allowing an axial movement of the two sealing elements relative to each other.

The function of this modified transport nozzle array is illustrated by FIGS. 14 to 16:

In the operating state according to FIG. 14 the two rods 49 are pulled out of the nozzle housing 38 up to the stop. Consequently, the nozzle element 45 is in a position of maximum opening of the first nozzle gap 62, thus resulting in an operating state similar to that of FIG. 8. Due to the compression springs 54, the other nozzle element 46 is pressed with great force against its seat 70, so that the nozzle gap 72 that is otherwise open at that point is closed. The gap flow indicated at 64 conveys the passing material strand in the transport direction 17. The gap width of the first nozzle gap 62 can be adjusted by appropriately adjusting the nozzle element 45 by means of the rod 49 as desired for the given purpose, without—as a result of this—opening the nozzle gap 72 that is delimited by the other nozzle element 46 pressed by the springs 54 stationarily against the seat 70.

In the operating state shown in FIG. 15 the two rods 49 are pushed further into the nozzle housing 38, i.e., far enough that the first nozzle gap 62 between the nozzle element 45 and the cover plate 37 being fixed relative to the housing and the other nozzle gap 72 between the nozzle element 46 and the base plate 34 being a part of the nozzle housing 37 are closed. The two nozzle elements 45, 46, that are pressed against their respective seats in a fluid-tight manner at the maximum axial distance from each other, are sealed by the sealing location formed by the apron 450 and the sealing ring 451 in contact with said apron, so that no transport medium can penetrate between them.

Consequently, in this operating position, the drive flow of the transport nozzle is completely switched off. The transport nozzle takes over the function of an otherwise necessary shutoff valve in the supply line 26 of the tube section conveying the transport medium flow. The nozzle gap 67 existing between the movable nozzle elements 45, 46 in the embodiment according to FIGS. 8 to 12 is closed by the apron 450 and the sealing ring 451. By eliminating the otherwise necessary shutoff valve, the design of the entire material strand transport system can be embodied in a clearly more cost-effective manner.

Finally, FIG. 16 shows an operating state which corresponds to the operating state according to FIG. 11. The two rods 49 are inserted into the nozzle housing 38 up to the stop on the cover plate 37, thus closing the first nozzle gap 62 between the nozzle element 45 and the cover plate 37. The other nozzle gap 72 between the nozzle element 46 and the base plate 34 forming a part of the nozzle housing 38 is open. With this setting of the nozzle elements 45, 46, a reverse-directed jet of the transport medium is generated as indicated by the gap flow 75. Therefore, the material strand is transported in reverse. A transport medium passage between the two nozzle elements 45, 46 is prevented by sealing location formed by the apron 450 and the sealing ring 451.

Finally, it should be mentioned that the mechanism comprising the link mechanism 55 represents, with the rods 49, only a particularly practical and simple exemplary embodiment of the adjustment mechanism of the two nozzle elements 45, 46. To the person skilled in the art, there result also other equally acting adjustment mechanisms for the nozzle elements 45, 46 in such a manner that they can assume the operating positions explained in conjunction with FIGS. 8 to 11 and 14 to 16. The described lever assembly of the link mechanism 55 for adjusting the nozzle elements 45 46 is particularly cost-effective. This lever assembly can be driven via the actuating rod 60 by a digital actuating element, for example, that consists of a spring-loaded pneumatic bellows to which a pressure medium is applied via pulsed valves.

The number of nozzle elements is not restricted to two nozzle elements 45, 46 as chosen for the exemplary embodiments. More than two, for example three, nozzle elements may be provided, between which a correspondingly larger number of selectively opened nozzle gaps similar to the nozzle gap 67 are formed. Additionally, also embodiments having only one nozzle element that allows the selective adjustment of the operating states of FIG. 8 and of FIG. 11 are conceivable. Preferably, the nozzle gaps are continuously adjustable; however, depending on the operating conditions, an incremental adjustment is also possible. The nozzle gap width may be adjusted individually, which, as a rule, applies to all the embodiments of the nozzle array, however other embodiments wherein the gap widths of the individual nozzle gaps are controlled as a function of reciprocal dependency, are also conceivable. Finally, it should be mentioned that, in the exemplary embodiments described hereinabove the nozzle gaps are configured as annular gaps enclosing the material strand so that a continuous annular flow in circumferential direction results as the gap flow. Also possible are embodiments, wherein the gap flow is discontinuous in circumferential direction, i.e., consists of individually spaced-apart transport medium jets that act on the passing material strand.

In a device for the treatment of strand-shaped textiles in the form of a rotating material strand that is put into rotation during at least a part of its treatment, a transport nozzle array 14 for the material strand is provided, said array comprising a transport nozzle 30 with a nozzle housing 38, wherein at least two nozzle gaps for the transport medium are delimited. At least one nozzle gap 62 of the two nozzle gaps is disposed for conveying the material strand that passes through in transport direction 170, and at least one nozzle gap 72 is disposed for conveying the material strand that passes through in a direction counter the transport direction.

The invention claimed is:

1. A device for the treatment of strand-shaped textiles where material strands are rotated during at least a part of the treatment, the device comprising:

a treatment container;

a transport nozzle array to which a transport medium flow can be applied;

a transport path adjoining the transport nozzle array, by way of which a material strand can be moved through the transport nozzle array in a transport direction, wherein:

the transport nozzle array comprises a transport nozzle with a nozzle inlet orifice and a nozzle outlet orifice for the material strand that passes through, between which are delimited at least two nozzle gaps for the transport medium;

at least one of the nozzle gaps is adjustable regarding its gap width; and of the nozzle gaps, at least one nozzle gap is disposed for conveying the material strand that passes through in the transport direction, and at least one nozzle gap is disposed for conveying the material strand that passes through in a direction counter to the transport direction;

control means for selectively driving the material strand passing through in the transport direction or in the direction counter to the transport direction by way of an appropriate actuation of the nozzle gaps; and a nozzle housing comprising the nozzle inlet orifice and the nozzle outlet orifice, wherein:

at least two nozzle elements are adjustably supported in the nozzle housing so as to be adjustable relative to each other in an axial direction, the nozzle elements delimiting two nozzle gaps with parts of the nozzle housing and at least one nozzle gap between the nozzle elements, and spring means are provided between the nozzle elements, the spring means being biased to effect a change in a distance between the nozzle elements and being controllable by the control means.

2. The device of claim 1, wherein at least one of the nozzle gaps is configured as an annular gap enclosing the material strand that passes through.

3. The device of claim 1, wherein the gap widths of the nozzle gaps are configured so as to be changeable independently of each other.

4. The device of claim 1, wherein at least one of the nozzle gaps can be adjusted continuously.

5. The device of claim 1, wherein all nozzle gaps are arranged in a common nozzle housing.

6. The device of claim 1, wherein the control means comprises a link mechanism that is coupled with the nozzle elements in order to impart them with an adjustment motion.

7. The device of claim 1, wherein the nozzle housing is at least partially designed as a formed sheet metal element.

8. The device of claim 1, wherein the nozzle gaps are configured so as to be closable for conveying the passing material strand in the transport direction and in the direction counter to the transport direction and so as to be able to be controlled by the control means to effect a combined closure of the nozzle gaps.

9. The device of claim 1, further comprising at least two annular nozzle elements enclosing the passing material strand.

10. The device of claim 8, wherein the nozzle elements delimit two nozzle gaps with parts of the nozzle housing enclosing the nozzle elements, and the nozzle elements that can be adjusted relative to each other in the axial direction are sealed relative to each other.

11. The device of claim 10, wherein an axially movable sealing location is arranged between the nozzle elements.

* * * * *